US006190044B1

(12) United States Patent
Fox et al.

(10) Patent No.: US 6,190,044 B1
(45) **Date of Patent: *Feb. 20, 2001**

(54) PRODUCE BAG WITH IMPROVED STRENGTH AND LOADING FEATURES

(75) Inventors: L. Keith Fox; Kenneth S. Fox, both of McAllen, TX (US)

(73) Assignee: Kenneth Fox Supply Company, McAllen, TX (US)

( * ) Notice: Under 35 U.S.C. 154(b), the term of this patent shall be extended for 0 days.

This patent is subject to a terminal disclaimer.

(21) Appl. No.: 09/349,312

(22) Filed: Jul. 8, 1999

Related U.S. Application Data

(63) Continuation-in-part of application No. 09/174,435, filed on Oct. 16, 1998, now Pat. No. 6,030,120, and a continuation-in-part of application No. 09/212,169, filed on Dec. 16, 1998, now Pat. No. 6,024,489.

(51) Int. Cl.[7] ..... B65D 30/06
(52) U.S. Cl. ..... 383/9; 206/554; 383/117
(58) Field of Search ..... 383/9, 117; 206/554

(56) References Cited

U.S. PATENT DOCUMENTS

| | | | |
|---|---|---|---|
| 1,822,948 | | 9/1931 | Armstrong . |
| 1,906,500 | | 5/1933 | Twitchell . |
| 2,085,365 | | 6/1937 | Israel . |
| 2,128,658 | | 8/1938 | Millett . |
| 2,428,266 | | 9/1947 | Daniels . |
| 2,646,203 | | 7/1953 | Brady . |
| 2,774,402 | | 12/1956 | Wikle . |
| 2,853,225 | | 9/1958 | Bauer . |
| 2,952,397 | | 9/1960 | Doyle . |
| 3,123,279 | | 3/1964 | Day . |
| 3,257,915 | * | 6/1966 | Cartier et al. ..... 383/117 |
| 3,279,511 | | 10/1966 | Griffin, Jr. . |

(List continued on next page.)

FOREIGN PATENT DOCUMENTS

| | | |
|---|---|---|
| 677450 A1 | 3/1995 | (EP) . |
| 837421 | 6/1960 | (GB) . |

OTHER PUBLICATIONS

"FD–35V High–speed, center press–seal, automatic bag making machine" [online], Totani Corp., 1997, [retrieved on Jul. 12, 1999]. Retrieved from the Internet: <URL: www.totani.co.jp/ENGLISH/E_SC/E_FDFA/eFDF35.htm.

*Primary Examiner*—Stephen P. Garbe
(74) *Attorney, Agent, or Firm*—Bracewell & Patterson, L.L.P.

(57) ABSTRACT

A produce bag has one side wall of a synthetic resin mesh material. The bag offers increased strength and reliability when used with automatic bag filling equipment. The mesh material forms a rear wall of the bag when a group of the bags are placed on wicket pins of the equipment for receiving produce. The front or forward wall is of a synthetic resin film. A reinforcing strip of synthetic resin film is formed along an upper portion of the mesh wall of the bag and spaced holes for wicket pin attachment are formed in the reinforcing strip. The synthetic resin film side wall has a side wall portion which extends below the mesh wall, with a lower fold being formed in the film wall to form a bottom of the bag. The synthetic resin film side also has an extension from the lower fold which is folded upwardly to join with and enclose a lower portion of the mesh side wall. The bottom portion of the bag is thus formed of synthetic resin film which yields to the impact of articles entering the bag to fill it. No seam is present between the side walls of the bag in the bottom area of the bag where it would be subject to the impact of entering articles. Top corner juncture portions of the bag are formed where the reinforcing strip, mesh wall and resin wall overlap to afford increased bag strength, as well. The bag provides greater strength, uniformity, and reliability in automatic produce packing machine operations.

28 Claims, 4 Drawing Sheets

U.S. PATENT DOCUMENTS

| | | | | |
|---|---|---|---|---|
| 3,554,368 | * | 1/1971 | Nagel | 383/117 |
| 3,721,603 | | 3/1973 | Takeda . | |
| 3,733,024 | | 5/1973 | Bolling, Jr. . | |
| 3,967,544 | | 7/1976 | Brock et al. . | |
| 4,002,519 | | 1/1977 | Mosley et al. . | |
| 4,207,983 | * | 6/1980 | Wolske | 383/117 |
| 4,301,961 | | 11/1981 | Rodish . | |
| 4,386,924 | | 6/1983 | Crawford et al. . | |
| 4,403,637 | * | 9/1983 | Sabater et al. | 383/117 |
| 4,451,249 | | 5/1984 | DeBin . | |
| 4,491,217 | | 1/1985 | Weder . | |
| 4,566,927 | | 1/1986 | Wood . | |
| 4,832,677 | | 5/1989 | Hudgens et al. . | |
| 4,881,933 | | 11/1989 | Wech . | |
| 4,883,450 | | 11/1989 | Benoit . | |
| 4,889,523 | | 12/1989 | Sengewald . | |
| 4,974,968 | | 12/1990 | Mandus et al. . | |
| 4,988,213 | * | 1/1991 | Mattle | 206/554 |
| 5,294,148 | | 3/1994 | Imai . | |
| 5,401,101 | * | 3/1995 | Wang | 383/117 |
| 5,417,638 | | 5/1995 | Anderson et al. . | |
| 5,571,361 | | 11/1996 | Stuerzel . | |
| 5,741,076 | * | 4/1998 | Cammack | 383/117 |
| 5,823,683 | | 10/1998 | Antonacci et al. . | |
| 6,024,489 | * | 2/2000 | Fox et al. | 383/117 |
| 6,030,120 | * | 2/2000 | Fox et al. | 383/117 |

* cited by examiner

PRODUCE BAG WITH IMPROVED STRENGTH AND LOADING FEATURES

CROSS-REFERENCE TO RELATED APPLICATIONS

The present application is a continuation-in-part of prior U.S. patent applications Ser. Nos. 09/174,435, filed Oct. 16, 1998 , now U.S. Pat. No. 6,030,120, and 09/212,169, filed Dec. 16, 1998 now U.S. Pat. No. 6,024,489.

FIELD OF THE INVENTION

The present invention relates to produce bags adapted for use on wicket pins of automatic produce packing machines.

BACKGROUND OF THE INVENTION

Wicket produce bags have been developed for automatic produce packing machines. One portion of the bag has holes formed in it so that the bags can be suspended from wickets or pegs on an automatic packing machine. The earliest such bags were of polyethylene film.

Produce bags formed of a synthetic resin fabric mesh have been recently developed by the assignee of the present application, for example as described in co-pending U. S. patent application Ser. No. 08/888,175, filed Jul. 3, 1997. These bags were formed of a synthetic resin fabric mesh, such as the woven fabric of cross-laminated synthetic resin fibers known as Cross Laminated Airy Fabric or (CLAF) from Amoco Fabrics & Fibers, Inc. This fabric is an open mesh material of cross-laminated warp and weft strands or fibers of synthetic resin.

These types of bags are particularly useful for produce that must have access to fresh air to preserve the shelf life of the produce. However, when wicket holes are formed in this type of fabric mesh for automatic produce bag filling or packing machine purposes, problems have been found to occur. Slits were formed in the mesh in the area of the wicket holes leading away from the holes. The slits were formed in order to aid in tearing of the bag away from the packing machine once the bag was filled with product.

When the fabric mesh was slit for this purpose near the wicket holes, only a certain number of synthetic resin fiber strands in the fiber mesh were left uncut. The remaining uncut fiber strands were the sole support for the bag when it was suspended from the wicket rods or pegs and being filled with product. The number of strands left uncut was variable and indeterminate, and the reliability of the bags for use in automatic packing machines suffered. Bags with too many strands cut did not have adequate strength for use and would fall from the wickets during filling operations. Faulty bags could slow up operation of automatic packing machines by falling from the wickets when being filled with produce.

Composite bags formed of one synthetic resin mesh sheet and one synthetic resin film sheet have been proposed. So far as is known, however, the two sheets have been joined together along a common inner seam formed between the two walls at a bag bottom on or near the bottom portions of the sheets. The common inner seam was thus located to form the bottom of the contents holding portion of the bag. However, with this structure, problems have arisen, particularly with relatively large or comparatively heavy items such as potatoes or other produce. The weight and impact of these types of items as they were introduced during bag filling was received directly onto the seam joining the bag wall sheets together. Problems with breakage or rupture of the seams have occurred because of this. Further, bag filling operations have been disrupted and products for filling the bags spilled or wasted.

BRIEF SUMMARY OF THE INVENTION

Briefly, the present invention provides a new and improved composite synthetic resin bag for use with wicket pins of automatic bag filling or packing equipment. The bag is formed of first and second side walls which are joined together along a bottom portion and two side edges. One of the side walls is formed from a cross-laminated synthetic resin fiber material mesh, such as a CLAF material or the like. The wall of mesh material forms a back or rear wall of the bag when placed on wicket pins of the equipment for product filling. The front or forward wall is formed of a synthetic resin film, such as polypropylene or polyethylene or the like. The fiber mesh side wall of the bag has a reinforcing strip of synthetic resin film extending along an upper edge. A wicket top is formed in the reinforcing strip for mounting the bag on the wicket pins of the bag packing machine or equipment. The reinforcing strip extends behind the rear mesh wall a length adequate to be brought into sealing contact with contact the front film bag wall and holding the rear mesh bag wall in firm engagement between the two resin film pieces.

The rear bag wall extends downwardly a certain predetermined length, but slightly less than the entire length of a completed bag. The front bag wall extends over a front face portion the entire length of a completed bag and in addition has a further downward extension. When the bag is assembled, the downward extension is folded upwardly against an outer surface of the fiber mesh rear bag wall. The fiber mesh bag wall and the upwardly folded film wall extension are joined together at a seam spaced upwardly from the folded synthetic resin bottom portion. The bag when assembled thus has a bottom portion which is formed entirely of a folded portion of synthetic resin film. The resin film has been found to be more elastic and thus resistant to impact and weight of produce as they enter the bag during packing.

It has been found that the fold of synthetic resin film exhibits greater strength during bag packing. Further, the seam between the fiber mesh wall and the film wall is spaced upwardly from the bottom of the bag and thus not directly subject to impact and weight of the product as it enters the bag during packing. An improved top corner seal structure is provided where the reinforcing strip and the front and rear side walls are joined. Bags according to the present invention exhibit greater strength in use during packing operations and are thus more reliable. Waste and damage to produce as a result of bags splitting at their bottom seams, either during loading or subsequent handling, are reduced with bags according to the present invention.

BRIEF DESCRIPTION OF THE DRAWINGS

The objects, advantages and features of the invention will become more apparent by reference to the drawings appended thereto, wherein like numerals indicate like parts and wherein an illustrated embodiment of the invention is shown, of which.

DETAILED DESCRIPTION OF PREFERRED EMBODIMENT

Figure 1:
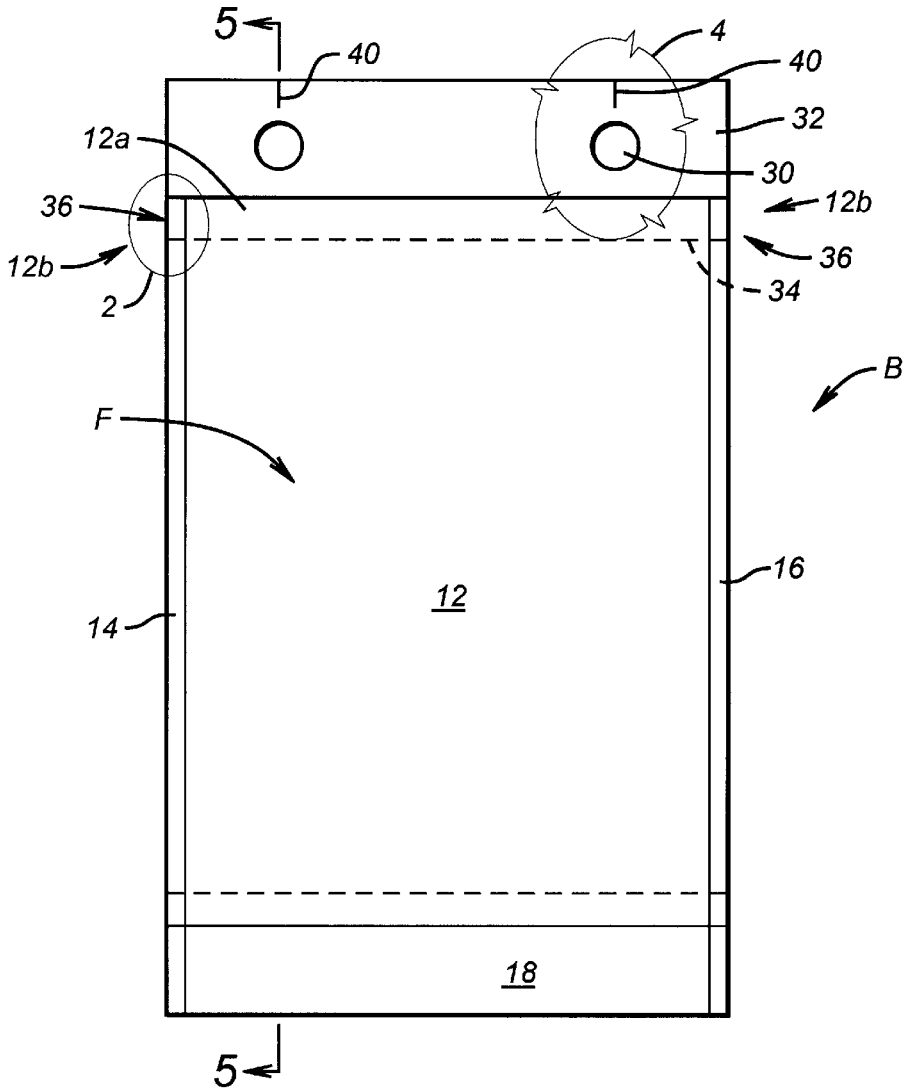
FIG. 1 is a front elevation view of a produce bag according to the present invention.

In the drawings, the letter B designates generally a wicket-top synthetic resin bag according to the present invention. The bag B is specifically adapted for use with wicket pins of commercially available automatic produce bag filling equipment. The following chart is a list of examples of bag filling equipment for which bags according to the present invention may be used:

| SOURCE | MODEL |
|---|---|
| Ag-Pak, Inc. | Double Ag-Pak Weigh/Bagger |
| Ag-Pak, Inc. | Octopak Rotary Bagger |
| Ag-Pak, Inc. | Mega Pak Bagger |
| Yakima Wire Works | MBU/9300 Automatic Poly Bagger |
| Spang & Brands | Automatic Weigher/Bagger |
| Automatic Bagging Systems, Inc. | Vindicator Bagger |
| Lockwood Packing Corp. | Carousel Bagger |
| Volm Bag Co. | VP10 & VP12 with carousel bagger |

Figure 6:
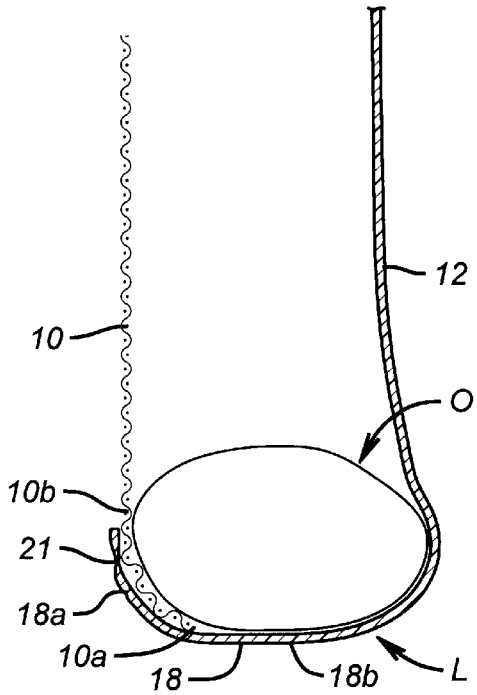
FIG. 6 is a cross-sectional view of a lower portion of the bag of FIG. 5 receiving an item or object of produce during filling.
Figure 9:
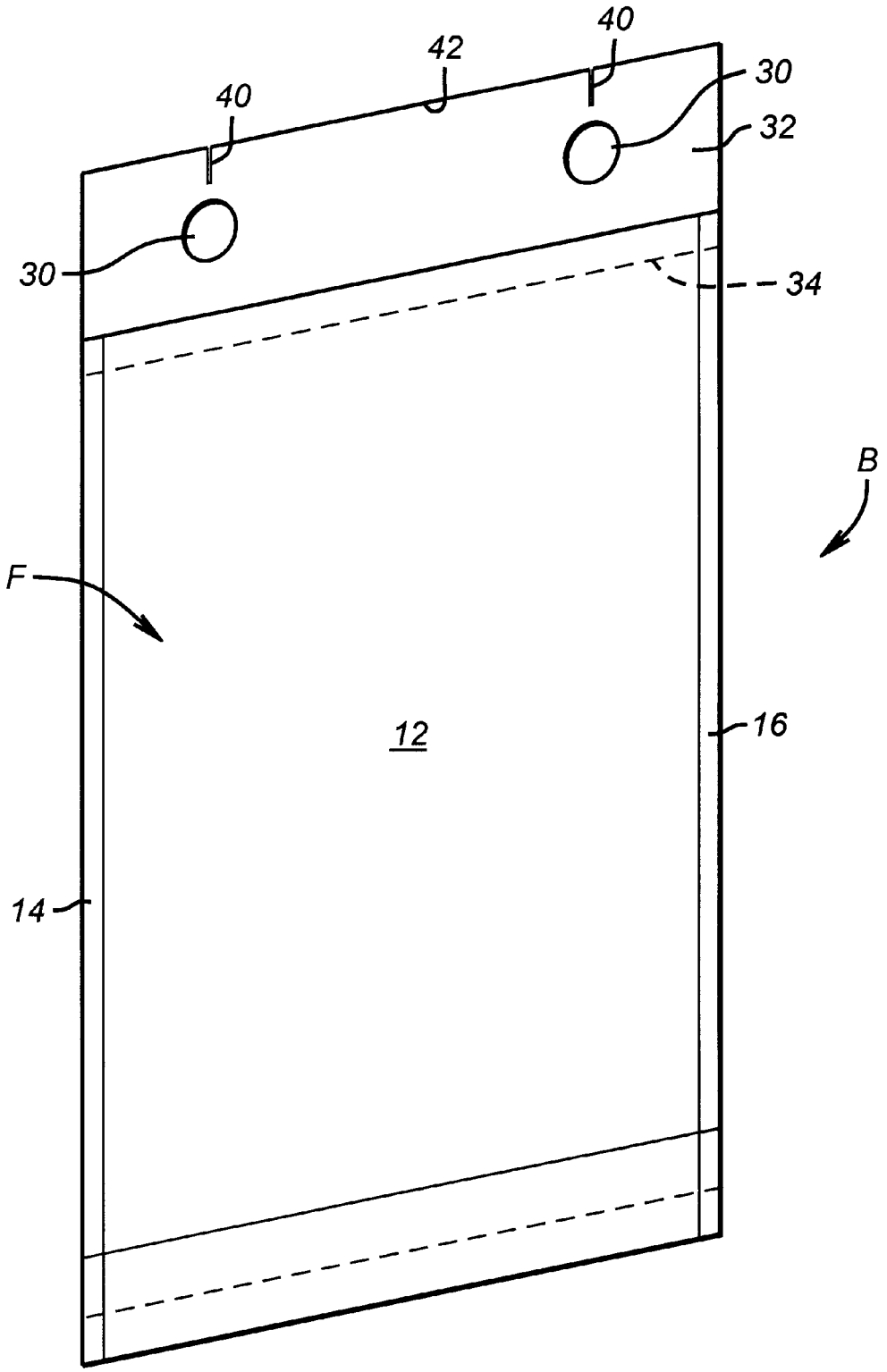
FIG. 9 is an isometric view of the bag of FIG. 1.

The bag B has a first or rear side wall 10 (FIG. 6), which is formed of a suitable synthetic resin fiber mesh. One type of such a mesh is the cross-laminated airy fabric material, or CLAF, available from Amoco Fabrics & Fibers, Inc. This type of fiber mesh or fabric is an open mesh material of cross-laminated warp and weft strands or fibers of a suitable synthetic resin.

A second or front side wall 12 of the bag B in the preferred embodiment is a suitable synthetic resin film, such as polyethylene or polypropylene, numerous types of which are commercially available. An example film is 2.25 mil NPE with an EVA additive. Air or breather holes may be formed in film 12, if desired.

With the present invention, the mesh sidewall 10 is a rearwall of the bag B and the film side wall 12 is a front or forward wall. The bag B is placed in groups or sets on wicket pins of automatic filling equipment to receive and be filled with produce. As will be set forth below, the resin film wall 12 faces outwardly or to the front, ahead of the rear mesh wall 10, when properly installed.

The particular horizontal and vertical dimensions of the side walls 10 and 12, as well as their thickness, are determined based on the expected weight and size of produce to be packed into the bag B by automatic produce packing machinery. The chart below gives example sizes for bags intended for various produce weights:

| PRODUCE WEIGHT | BAG WALL DIMENSION |
|---|---|
| 2 pounds | 10 inches by 16 inches |
| 3 pounds | 10.5 inches by 16 inches |
| 5 pounds | 10.5 inches by 19 inches |
| 10 pounds | 13 inches by 23 inches |

For bags of these sizes, the reinforcing strip, discussed in more detail below, is typically 1.5" or so in height.

The bags B may be formed by hand or machines and preferably formed by machine. A suitable type of such machine has been manufactured by Hudson-Sharp Machine Co. of Green Bay, Wis.

The side walls 10 and 12 are bonded or sealed to each other along vertically extending side seams as indicated at 14 and 16. The seams 14 and 16 may be of any desired width, depending on holding strength desired for the bag B along its vertical sides. The joining of side walls 10 and 12 at the seams 14 and 16 may be done by any suitable bonding or sealing technique, such as heat, glue, sealant, or the like.

The first or rear side wall 10 extends downwardly only a certain length to a lower edge 10*a* (FIG. 5) which is slightly less than the entire length of a completed bag. For example, in a bag for five pounds of produce the mesh side wall extends only 18-½ inches for a typical bag depth of twenty inches.

Figure 5:
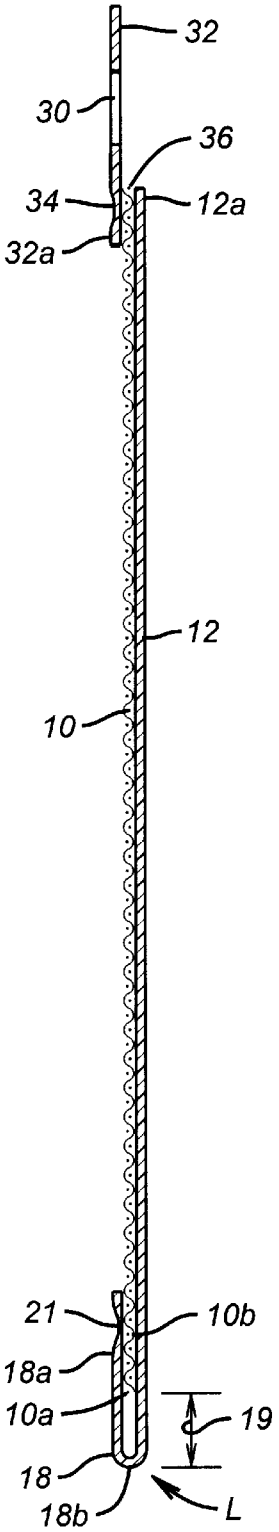
FIG. 5 is a cross-sectional view taken along the lines 5—5 of FIG. 1.
Figure 10:
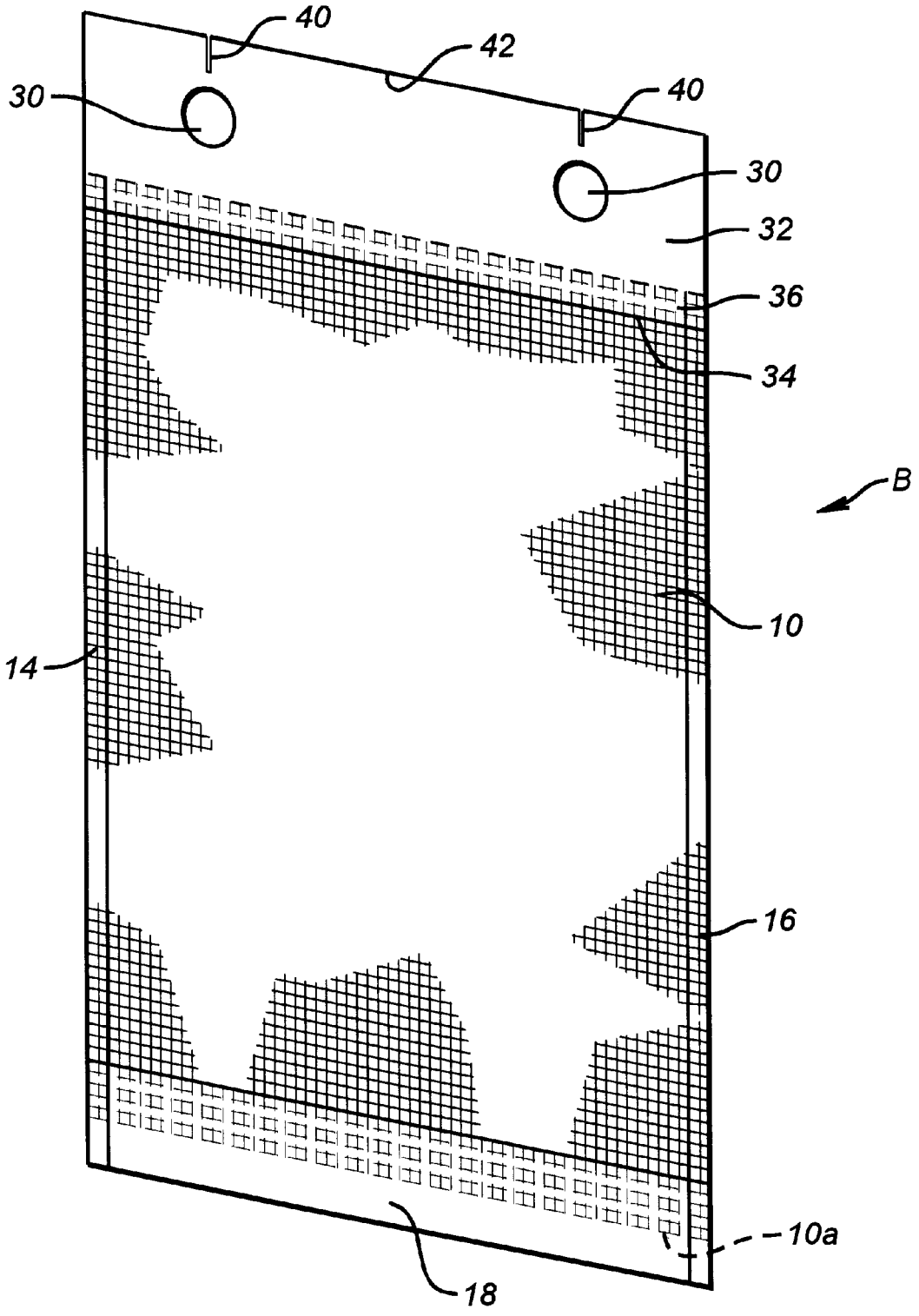
FIG. 10 is an isometric view of the bag of FIG. 1, taken from an opposite direction to that of FIG. 9.

The front or film bag wall 12 extends over a front face portion F over the entire length of the assembled bag B. The second or front side wall 12 also has a lower side wall extension portion 18 (FIGS. 1, 5 and 10) somewhat longer in vertical extent, for example three inches or so for a five pound produce bag, than the first or rear mesh side wall 10. The extension 18 extends downwardly a first length of about one-half inch or so for a five pound bag, as indicated by an arrow 19 (FIG. 5). As the bag B is being assembled, the extension 18 is folded upwardly against an outer surface 10*b* of the rear mesh bag wall 10.

A portion 10*b* of the rear fiber mesh bag wall 10 above the edge 10*a* and an upper portion 18*a* of the extension 18 are joined together as indicated at 21. The joining may be by any suitable bonding or sealing technique of the type previously mentioned. The bag B when assembled thus has a lower fold L formed as a bottom portion 18*b* of the extension 18 of the front resin wall 12.

The fold L of resin exhibits and possesses no seam. Thus, when a produce object O or some other product falls into the bag B (FIG. 6), their weight and impact is received along a continuous, unitary strip of synthetic resin film fiber, formed by the fold L. No seam is present between the side walls in the area of the fold L receiving the impact of entering articles. This continuous strip of material in the fold L exhibits greater strength during bag packing or loading. In addition, the seam or junction 21 is located upwardly away from the fold L at the bottom 18*b* of the bag. The seam or junction 21 is thus not directly subject to impact and weight of the produce or other product as it enters the bag B during packing.

The bag B is provided with a suitable number, usually at least two, of laterally aligned wicket holes 30 in a reinforcing strip 32 for suspension in an automatic produce packing machine so that the bag B may be filled with produce or product. The size of the wicket holes 30 is based upon the produce packing machine with which the bags B are to be used. A typical size of wicket hole 30 is one-half inch or so, for example.

According to the present invention, the reinforcing strip 32 is formed of a suitable synthetic resin film, for example like that of the front bag wall 12. The reinforcing strip 32 is bonded or sealed, as indicated at 34 across a laterally extending seam at an upwardly extending portion 36 of the mesh material of the first side wall 10. Joining of the strip 32 to the side wall 10 at the seam 34 may be done in accordance with the bonding or sealing techniques previously described. The synthetic resin film of the reinforcing strip 32 may, as noted, be of the same or, alternatively, a similar synthetic resin material as the second side wall 12. The thickness and strength of the resin material of the strip 32 is selected according to the size of the bag B, as well as the weight of the produce to be packed into it.

Figure 2:
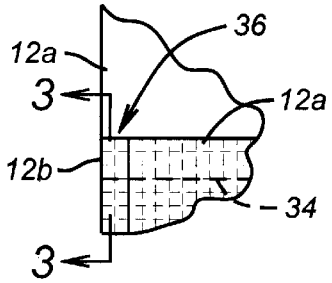
FIG. 2 is an enlarged view of a portion of the bag of FIG. 1 encircled and having reference numeral 2 indicating same.
Figure 3:
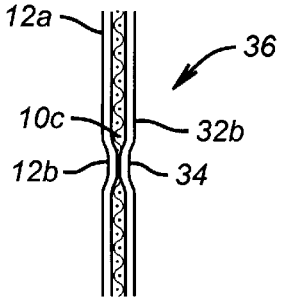
FIG. 3 is an enlarged, cross-sectional view taken along the lines 3—3 of FIG. 2.
Figure 4:
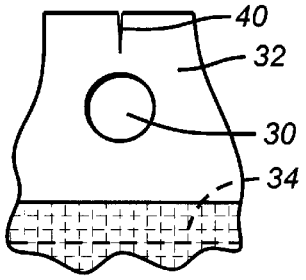
FIG. 4 is an enlarged view of a portion of the bag of FIG. 1 encircled and having reference numeral 4 indicating same.

The reinforcing strip 32 extends as indicated at 32*a* downwardly below an upper lip or edge 12*a* of the front side wall 12 when mounted to the rear mesh wall 10. A top corner area portion 12*b* (FIGS. 2 & 3) at each side of the edge 12*a* of the front film wall 12 is bonded or sealed to a corresponding area 32*b* of the reinforcing strip 32. This bonding or sealing occurs at each side of the lower portion 32*a* of reinforcing strip 32. The areas or portions 12*b* and 32*b* are in overlapping a real extent with each other and have upper top corner portions 10*c* of the rear mesh side wall located therebetween. The three overlapping portions 12*b*, 10*c*, and 32*b* are bonded or otherwise sealed together (FIG. 4) to former top corner wall seal junctures 36. In those areas of this overlapping seal portion where fiber strands of the open mesh of the mesh portion 10*c* are not present, the overlapping resin film wall portions 12*b* and 32*b* fuse directly together, enclosing the fiber strands between them. This provides increased strength and holding power for the bag B at upper or top corner portions. The lateral seam 34 between reinforcing strip 32 and rear wall 10 extends laterally between the top corner wall seal junctures 36.

Figure 7:
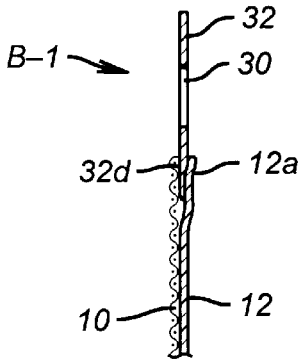
FIG. 7 is a cross-sectional view of alternative bag top to that of FIG. 5.

A bag B-1 (FIG. 7) shows a structural feature of the reinforcing strip 32 which is adapted for the bag B. The lower portions of bag B-1 are not shown, but they are of like structure to the bag B. As shown in FIG. 7, there in forcing strip 32 may be of a sufficient vertical extent so that an elongate inwardly extending border or lip 32*d* is formed between the top corner wall seal juncture areas 30. The lip 32*d* extends inwardly along upper portions 10*a* of the side wall 10 and an adequate dimension, usually at least one-half inch into the bag B, below the top lip 12*a* of the side wall 12. This additional portion added of reinforcing strip 32*a* affords a greater surface area of mesh to film bond laterally across the width of strip 32 between the mesh of side wall 10 and the film of reinforcing strip 32. This offers increased strength in the bond at the top of the bag.

The wicket reinforcing strip 32 of bags B and B-1 may also be provided with leaders, or cuts, 40 (FIGS. 1 and 4A) extending inwardly downwardly from an upper edge 42 opposite the seam 34 in the strip 32. The leaders 40 assist in removal of the bag B from the wicket pins in the packing machine once the bag B is filled. It is to be noted that the leaders or cuts 40 are not formed in the mesh material of the first side wall 10. This location of the leaders 40 affords further increased strength and reliability in the bag B over wicket bags formed completely of fabric mesh.

Figure 8:
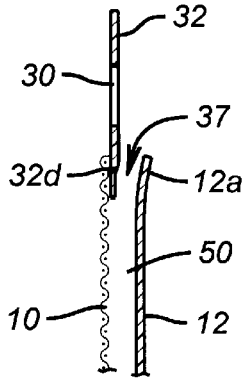
FIG. 8 is a view of an upper portion of the bag of FIG. 7 partially open to be packed with produce.

Another advantage of the bags B and B-1 of the present invention is the location of the mesh side wall 10. The mesh side wall 10 is, as noted previously, is a rear bag wall when the bags are installed on wicket pins of the packing equipment. The front film side wall 12 thus faces forwardly on the produce packing machine to receive produce through the gap 37 (FIG. 8) at the top below reinforcing strip 32.

In a number of packing machines, the bag walls are partially separated as indicated at 50 (FIG. 8) either by blown air or suction to enlarge the top gap 37 for filling purposes. With the film side wall 12 on the front or forward face on the machine, the separating suction forces or bursts of air act on the enlarged surface area of the forward film side wall 12 rather than on the rear mesh wall portion 10. This opens the bags and greatly facilitates use of the bags B and B-1 in packing machines due to the top gap 37 being enlarged for receipt of produce during packing.

From the foregoing, it can be seen that bags are provided which exhibit greater reliability during packing in automatic produce packing machines. The bags offer increased strength in holding produce and are more easily opened for filling. The bags exhibit better capability of staying on the wickets of the machines as produce is being packed. The bags of the present invention are also less likely to suffer from bag material tearing or failure during loading.

Having described the invention above, various modifications of the techniques, procedures, material, and equipment will be apparent to those in the art. It is intended that all such variations within the scope and spirit of the appended claims be embraced thereby.

What is claimed is:

1. A synthetic resin bag for use with wicket pins of automatic bag filling equipment, comprising:

first and second side walls joined along two side edges to form the bag;

one of the side walls being formed from a synthetic resin mesh;

one of the side walls being formed of a synthetic resin film;

a reinforcing strip of synthetic resin film extending along an upper edge of a side wall of the bag;

a sealing juncture formed along a side edge portion of each of the side walls and the reinforcing strip:

the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and said reinforcing strip having holes formed therein for mounting the bag on the wicket pins of the bag filling equipment.

2. The bag of claim 1, wherein the synthetic resin mesh is a synthetic resin fiber mesh.

3. The structure of claim 1, wherein the synthetic resin film side wall extension is mounted with the synthetic resin fiber mesh side wall.

4. The structure of claim 1, wherein the synthetic resin film side wall extension is mounted along a top of the upwardly folded extension with the synthetic resin fiber mesh side wall.

5. The structure of claim 1, wherein the synthetic resin film side wall extension is mounted with the synthetic resin fiber mesh side wall by a seam formed between them.

6. The structure of claim 1, wherein the synthetic resin film side wall extension is mounted along a top of the upwardly folded extension with the synthetic resin fiber mesh side wall by a seam formed between them.

7. The bag of claim 1, further including said reinforcing strip having slits cut therein at a location spaced from the holes to allow for removal of the bag from the filling equipment.

8. The structure of claim 1, wherein the reinforcing strip extends upwardly above an opening between the top portions of the first and second side walls.

9. The structure of claim 8, wherein the reinforcing strip is mounted with one of the side walls along a top portion thereof.

10. The structure of claim 1, wherein the reinforcing strip is mounted with one of the side walls along a seam formed therebetween.

11. The structure of claim 8, wherein the reinforcing strip is mounted with a top portion of the fiber mesh side wall.

12. A synthetic resin bag for use with wicket pins of automatic bag filling equipment, comprising:

first and second side walls joined along two side edges to form the bag;

one of the side walls being a rear side wall formed from a synthetic resin mesh;

the other of the side walls being a front side wall formed from a synthetic resin film;

a reinforcing strip of synthetic resin film extending along an upper edge of one of the side walls;

a sealing juncture formed along a side edge portion of each of the side walls and the reinforcing strip:

the front side wall having a bottom wall portion extending downwardly below the rear side wall and having a lower fold formed therein to form a bottom of the bag; and the front side wall having an extension from the lower fold which is folded upwardly to enclose a lower portion of the rear side wall.

13. The bag of claim 12, further including said reinforcing strip having holes formed therein for mounting on wicket pins of the bag filling equipment.

14. The bag of claim 13, further including said reinforcing strip having slits cut at a location spaced from the holes to allow for removal of the bag from the filling equipment.

15. The bag of claim 1, wherein the synthetic resin mesh wall extends downwardly a length less than the length of a completed bag.

16. The bag of claim 15, wherein the synthetic resin film side wall extends downwardly below the extent of the synthetic resin mesh wall to the lower fold.

17. A synthetic resin bag for use with wicket pins of automatic bag filling equipment, comprising:

first and second side walls joined along two side edges to form the bag;

one of the side walls being formed from a synthetic resin mesh;

one of the side walls being formed of a synthetic resin film;

a reinforcing strip of synthetic resin film extending along an upper edge of a side wall of the bag;

the synthetic resin fiber mesh side wall having the reinforcing strip of synthetic resin film mounted therewith extending along an upper edge of the mesh side wall;

the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and said reinforcing strip having holes formed therein for mounting the bag on the wicket pins of the bag filling equipment.

18. The bag of claim 17, further including:

the reinforcing strip having a portion extending below an upper lip of the synthetic resin film side wall.

19. The bag of claim 17, further including:

the reinforcing strip having a portion extending below an upper lip of the synthetic resin film side wall inwardly of the synthetic resin mesh side wall.

20. The bag of claim 17, further including:

the reinforcing strip having a portion extending below an upper lip of the synthetic resin film side wall outwardly of the synthetic resin mesh side wall.

21. A synthetic resin bag for use with wicket pins of automatic bag filing equipment, comprising:

first and second side walls joined along two side edges to form the bag;

one of the side walls being formed from a synthetic resin mesh; one of the side walls being formed of a synthetic resin film;

side walls of the bag being joined together along their vertical side extent to form side edges of the bag;

the side walls of the bag being joined without folding overlap to each other along their lateral side edges;

a reinforcing strip of synthetic resin film extending along an upper edge of a side wall of the bag;

the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and said reinforcing strip having holes formed therein for mounting the bag on the wicket pins of the bag filling equipment.

22. The bag of claim 21, wherein synthetic resin film side wall extension is secured to the synthetic resin fiber mesh side wall at a lower end thereof along a transverse seam across their lateral extent.

23. A synthetic resin bag for use with wicket pins of automatic bag filling equipment comprising:

first and second side walls joined along two side edges to form the bag;

one of the side walls being formed from a synthetic resin mesh;

one of the side walls being formed of a synthetic resin film;

a reinforcing strip of synthetic resin film extending along an upper edge of a side wall of the bag;

the reinforcing strip being mounted with a top portion of the fiber mesh side wall along a laterally extending seam formed between the reinforcing strip and the fiber mesh side wall, the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and said reinforcing strip having holes formed therein for mounting the bag on the wicket pins of the bag filling equipment.

24. The bag of clam 23, wherein a top corner portion of the fiber mesh side wall at each side of an upper edge of the film side wall is joined to the reinforcing strip with top corner portions of the fiber mesh side wall therebetween.

25. A synthetic resin bag for use with wicket pins of automatic bag filling equipment, comprising:

first and second side walls joined along two side edges to form the bag;

one of the side walls being formed from a synthetic resin mesh;

one of the side walls being formed of a synthetic resin film;

a reinforcing strip of synthetic resin film extending along an upper edge of a side wall of the bag;

the reinforcing strip being mounted with a top portion of the fiber mesh side wall along the laterally extending seam between them;

the reinforcing strip having holes formed therein for mounting the bag on the wicket pins of the bag filling equipment;

the reinforcing strip extending upwardly above an opening between the top portions of the first and second side walls;

the reinforcing strip being mounted with one of the sidewalls along a laterally extending seam formed therebetween.

26. The bag of claim 25, wherein a top corner portion of the fiber side wall at each side of an upper edge of the film side wall is joined to the reinforcing strip with top corner portions of the fiber mesh side wall therebetween.

27. A synthetic resin bag for use with wicket pins of automatic bag filling equipment, comprising:

first and second side walls joined along two side edges to form the bag;

one of the side walls being formed from a synthetic resin mesh;

one of the side walls being formed of a synthetic resin film;

the synthetic resin film side wall extension being mounted along a top of the upwardly folded extension with the synthetic resin fiber mesh side wall by a seam formed between them;

a reinforcing strip of synthetic resin film extending along an upper edge of a side wall of the bag;

the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and said reinforcing strip having holes formed therein for mounting the bag on the wicket pins of the bag filling equipment.

28. A synthetic resin bag for use with wicket pins of automatic bag filling equipment, comprising:

first and second side walls joined along two side edges to form the bag;

one of the side walls being formed from a synthetic resin mesh;

one of the side walls being formed of a synthetic resin film;

a reinforcing strip of synthetic resin film extending along an upper edge of a side wall of the bag;

the reinforcing strip being mounted with a top portion of the fiber mesh side wall;

the reinforcing strip extending upwardly above an opening between the top portions of the first and second side walls;

the synthetic resin film side wall having a bottom wall portion extending downwardly below the synthetic resin fiber mesh side wall and having a lower fold formed therein to form a bottom of the bag;

the synthetic resin film side wall having an extension from the lower fold which is folded upwardly to enclose a lower portion of the synthetic resin fiber mesh side wall; and the reinforcing strip having holes formed therein for mounting the bag on the wicket pins of the bag filling equipment.

* * * * *